US006562216B2

(12) United States Patent
Schlenkert et al.

(10) Patent No.: US 6,562,216 B2
(45) Date of Patent: May 13, 2003

(54) METHOD OF COATING AN INTERNAL SURFACE OF A WEAPON BARREL

(75) Inventors: Gert Schlenkert, Düsseldorf (DE); Horst Reckeweg, Heiligenhaus (DE); Hartmut Wagner, Unterlüss (DE)

(73) Assignee: Rheinmetall W & M GmbH, Unterlüss (DE)

( * ) Notice: Subject to any disclaimer, the term of this patent is extended or adjusted under 35 U.S.C. 154(b) by 30 days.

(21) Appl. No.: 09/764,122

(22) Filed: Jan. 19, 2001

(65) Prior Publication Data

US 2001/0025796 A1 Oct. 4, 2001

(30) Foreign Application Priority Data

Jan. 19, 2000 (DE) ..... 100 01 888

(51) Int. Cl.[7] ..... C25D 5/18

(52) U.S. Cl. ..... 205/104; 205/131; 205/179; 205/283

(58) Field of Search ..... 205/104, 131, 205/132, 178, 179, 283

(56) References Cited

U.S. PATENT DOCUMENTS 3,959,088 A * 5/1976 Sullivan ..... 204/14 R
4,138,512 A 2/1979 Glaski
5,433,797 A * 7/1995 Erb et al. ..... 148/304
5,527,445 A * 6/1996 Palumbo et al. ..... 205/103
6,329,071 B1 * 12/2001 Kobayashi et al. ..... 428/615

FOREIGN PATENT DOCUMENTS

| | | |
|---|---|---|
| DE | 39 07 087 | 9/1990 |
| EP | 1 003 008 | 5/2000 |
| FR | 2 460 340 | 1/1981 |

* cited by examiner

*Primary Examiner*—Nam Nguyen
*Assistant Examiner*—William T. Leader
(74) *Attorney, Agent, or Firm*—Venable; Norman N. Kunitz

(57) ABSTRACT

A method of coating a metal surface, particularly an inner surface of a gun barrel, with a chromium layer, includes the following steps: electrolytically precipitating on the metal surface a plurality of partial chromium layers in a superposed relationship by electric current pulses equaling the number of the partial chromium layers; and selecting the duration of each pulse such that a crystallite growth of individual partial chromium layers is stopped prior to a natural termination thereof for obtaining a globular polytropic structure of the entire chromium layer.

2 Claims, 2 Drawing Sheets

FIG.1
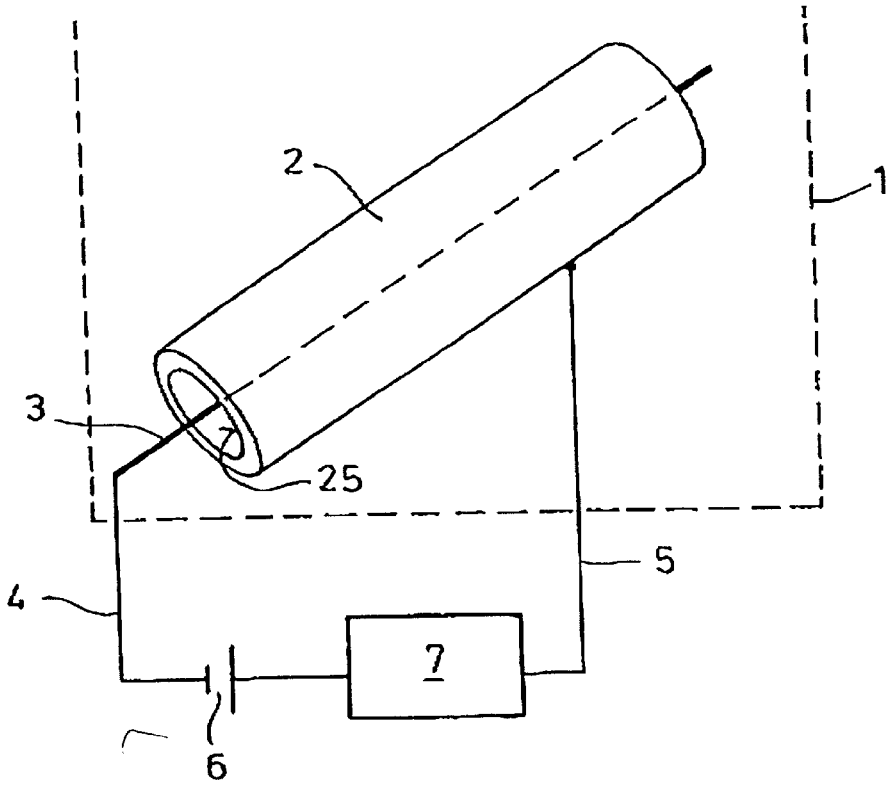
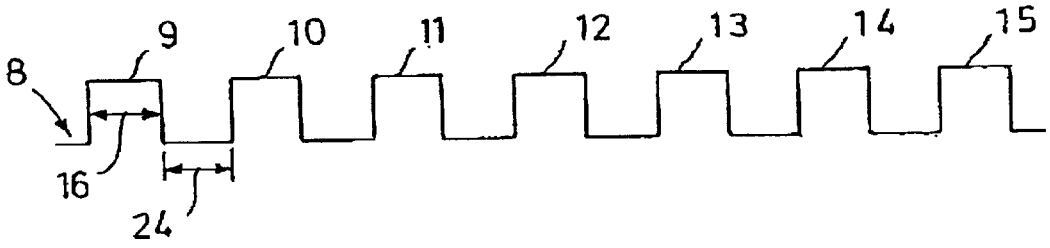
FIG.2

FIG.3
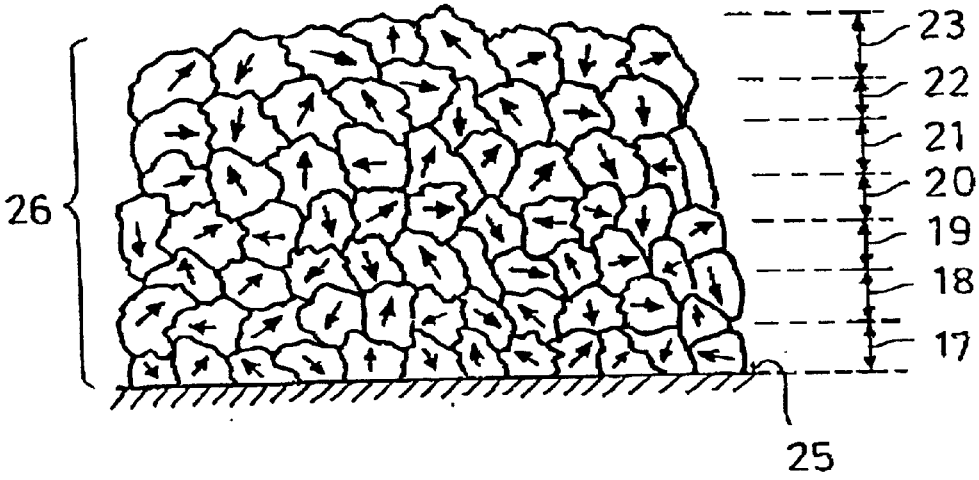
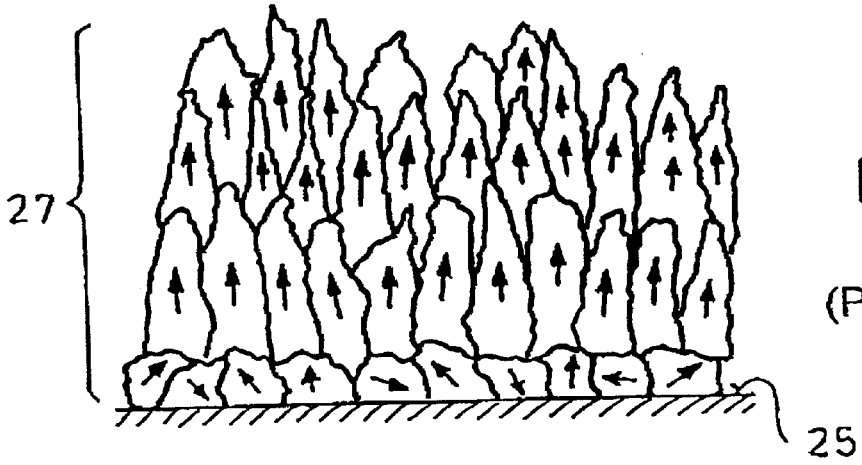
FIG.4
(PRIOR ART)

METHOD OF COATING AN INTERNAL SURFACE OF A WEAPON BARREL

CROSS REFERENCE TO RELATED APPLICATION

This application claims the priority of German Application No. 100 01 888.2 filed Jan. 19, 2000, which is incorporated herein by reference.

BACKGROUND OF THE INVENTION

This invention related to a method of coating a metal surface, particularly an inner surface of a weapon barrel by depositing thereon a chromium layer by electroplating for preventing erosions.

In weaponry, performance-enhanced ammunition causes significant erosions due to the high gas temperatures and flow velocities during firing, particularly in weapon barrels made of steel. Such erosions render the weapon barrel unusable before it reaches the end of its service life due to metal fatigue.

It is known to provide weapon barrels with a hard chromium layer for avoiding erosions of the above type. The hard chromium layer is deposited electrolytically on the inner face of the weapon barrel.

It is, among others, a disadvantage of such a known method that the electrolytically deposited hard chromium layers do not sufficiently withstand the effects of performance-enhanced ammunition. The resulting chromium breakouts often require a cost-intensive subsequent metal working.

Tests conducted by the applicants have shown that the chromium breakouts in the known hard chromium layers are caused to a large measure by the deposition-based (111) [uvw] texture and the bar-like microstructure of the chromium layer. These lead to a direction-dependent mechanical behavior of the chromium layers.

It has been found that in the conventional hard chrome deposition a distinction has to be made among three phases of crystallite growth: in a first phase a nucleation occurs, in a second phase the crystallite growth is in progress and in a third phase the crystallite growth is impeded and then stopped. The second phase results in a sharp (1-1-1) [uvw] texture of the chromium layer since such a texture layer has a higher growth velocity than other texture layers.

The slow-down of the crystallite growth or the growth stoppage is effected by impeding the growth of neighboring grains and/or by an increased defect rate in the growing process.

SUMMARY OF THE INVENTION

It is an object of the invention to provide an improved method of internally coating weapon barrels by means of a galvanically deposited hard chromium layer which does not lead to a significant, direction-dependent mechanical layer behavior, so that in use of the weapon barrel chromium breakouts are substantially prevented.

This object and others to become apparent as the specification progresses, are accomplished by the invention, according to which, briefly stated, the method of coating a metal surface, particularly an inner surface of a gun barrel, with a chromium layer, includes the following steps: electrolytically precipitating on the metal surface a plurality of partial chromium layers in a superposed relationship by electric current pulses equaling the number of the partial chromium layers; and selecting the duration of each pulse such that a crystallite growth of individual partial chromium layers is stopped prior to a natural termination thereof for obtaining a globular polytropic structure of the entire chromium layer.

While the chromium crystallites which are conventionally precipitated with a non-pulsed d.c. current, have a length of approximately 5–10 micron, when the precipitation is carried out according to the invention, the crystallites have a length of between approximately 0.2 and 2 micron. In this manner, by using a pulsed current, not only an isotropic texture is obtained, but also, a finer grain structure results which additionally leads to a better resistance of the chromium layer to stresses during service.

Apart from the fact that when using the method according to the invention, the obtained chromium layers are less sensitive to mechanical stresses than chromium layers produced conventionally, the method also has the advantage that by applying a plurality of chromium layers with polytrope structure, thicker, more stable chromium layers may be made than it has been possible with conventional methods.

By varying the current intensity and pulse duration the properties of the chromium layer precipitated on the inner surface of the weapon barrel may be varied between wide limits.

BRIEF DESCRIPTION OF THE DRAWING

FIG. 1 is a schematic view of an arrangement for precipitating chromium onto the inner surface of a weapon barrel.

FIG. 2 is a diagram showing the time curve of an electric current needed for precipitating seven partial chromium layers in a method according to the invention.

FIG. 3 is an enlarged view of the inner barrel surface illustrating the superposed partial chromium layers precipitated with a method according to the invention.

FIG. 4 is an enlarged view of the inner barrel surface illustrating a chromium layer precipitated by direct current according to the prior art.

DESCRIPTION OF THE PREFERRED EMBODIMENT

Turning to FIG. 1, a tub 1 shown in phantom lines contains an electrolytic liquid containing chromic acid. Further, a weapon barrel 2 to be internally coated is positioned in the tub 1. A rod-shaped electrode 3 passing axially through the weapon barrel 2 and the weapon barrel are coupled by respective electric conductors 4 and 5 with a current source 6 and a control apparatus 7.

As seen in FIG. 2, the control apparatus 7 generates a pulsed current 8 which has seven pulses 9–15 of predetermined height (intensity) and duration. Each pulse duration 16 is selected such that the crystallite growth of the partial chromium layers 17–23 (FIG. 3) precipitated by the current pulses 9–15 is in each instance interrupted before its natural termination. The individual partial chromium layers 17–23 have a layer thickness of, for example, 0.2 to 2 micron which corresponds to the length of the produced chromium crystallites. The arrows within the individual chromium crystallites indicate the texture orientation.

Also referring to FIG. 3, after a predetermined period 24 from the termination of the precipitation of the first partial chromium layer 17 onto the inner surface 25 of the weapon barrel 2, the second current pulse 10 passes through the electrolytic liquid between the electrode 3 and the weapon barrel 2 and thus the second partial chromium layer 18 is deposited onto the first partial chromium layer 17. Again, a nucleation with subsequent growth phase takes place while bar-like chrome crystallites build up on one another.

The above process is continued until the resulting chromium layer 26 composed of the individual partial chromium layers 17–23 has reached its predetermined thickness of, for examples 70 micron. As seen in FIG. 3, the chromium layer 26 is composed of a globular polytrope chromium structure.

FIG. 4 shows a chromium layer 27 which is conventionally deposited on the inner surface 25 of the weapon barrel 2 by means of a direct current and which likewise has a thickness of 70 micron. Here too, the arrows indicate the texture orientation. In this structure the chromium layer 27 has a sharp (111) [uvw] texture since the shown texture layer involves a higher growth velocity than other texture layers.

It will be understood that the above description of the present invention is susceptible to various modifications, changes and adaptations, and the same are intended to be comprehended within the meaning and range of equivalents of the appended claims.

What is claimed is:

1. A method of coating an inner metal surface of a gun barrel with a chromium layer, comprising the following steps:

(a) electrolytically precipitating, on the inner metal surface of a gun barrel, a plurality of partial chromium layers in a superposed relationship by electric current pulses equaling the number of the partial chromium layers; and (b) selecting the duration of each pulse such that a crystallite growth of individual said partial chromium layers is stopped prior to a natural termination thereof when the chromium crystallites reach a length of 0.2 to 2 micron for obtaining a globular polytropic structure of said chromium layer.

2. The method as defined in claim 1, wherein said plurality is at least 3.

* * * * *